US005234209A

United States Patent [19]

Weigel et al.

[11] Patent Number: 5,234,209

[45] Date of Patent: Aug. 10, 1993

[54] DISPENSING UNIT FOR PAPER CURRENCY

[75] Inventors: Peter Weigel, Borchen-Doerenhagen/BRD; Guenter Holland-Letz, Paderborn-Elsen/BRD; Ulrich Nottelmann, Bad Driburg, all of Fed. Rep. of Germany

[73] Assignee: Siemens Nixdorf Informationssysteme AG, Paderborn, Fed. Rep. of Germany

[21] Appl. No.: 162,929

[22] Filed: Mar. 2, 1988

[30] Foreign Application Priority Data

Mar. 3, 1987 [DE] Fed. Rep. of Germany ..... 3706829

[51] Int. Cl.[5] ..... B65H 1/00

[52] U.S. Cl. ..... 271/145; 271/162; 221/198; 221/287

[58] Field of Search ..... 271/145, 162–164; 221/4, 13, 154, 197, 198, 296, 287, 282; 109/47, 39, 51, 52, 63.5; 194/206, 207; 209/534; 235/379; 902/13

[56] References Cited

U.S. PATENT DOCUMENTS 4,189,139 2/1980 Uchida et al. ..... 271/162
4,515,288 5/1985 Atalla ..... 221/2 X
4,552,075 11/1985 Glasson et al. ..... 109/52
4,597,340 7/1986 Huckle ..... 109/52 X
4,638,746 1/1987 Ishigure ..... 109/52

*Primary Examiner*—David H. Bollinger
*Attorney, Agent, or Firm*—Dykema Gossett

[57] ABSTRACT

A dispensing unit for paper currency includes a box-shaped currency container (14) with a circuit that stores an identification code and with a frame-like receptacle module (12) into which the currency container (14) can be inserted, and a contact arrangement (146) of the currency container (14) can be connected by a mating contact arrangement (148) mounted on the receptacle module (12) to a polling and control circuit that controls the opening or locking of the currency container (14). In order to permit polling of the circuit in the currency container (14) during the insertion movement, the mating contact arrangement (148) is adjustable in the direction of insertion (A) of the currency container (14). An adjustable locking element (166) which is mounted on receptacle module (12) or on the currency container (14) and can be controlled by the control system, engages a catch element (196) on the other part such that in the engaged position of the locking element (166) and the catch element (196), the currency container (14) is some distance away from a draw-off and single feed mechanism (22, 26) of the receptacle module such that opening of its closure (42) is possible.

26 Claims, 5 Drawing Sheets

DISPENSING UNIT FOR PAPER CURRENCY

TECHNICAL FIELD

This invention concerns a dispensing unit for currency bills including a box-shaped currency container with an opening that can be closed by an adjustable closing element, a locking mechanism for the closing element, a circuit that stores an identification code and a contact arrangement connected to the circuit, a frame-like receptacle module into which the currency container can be inserted and which has a draw-off and single-feed device for single-feed of currency bills through the orifice in the currency container, whereby the contact arrangement of the currency container can be connected to a polling and control circuit that controls the lock mechanism by way of a mating contact arrangement located on the receptacle module.

BACKGROUND ART

In dispensing units such as those used in the construction of automatic money dispensing machines, the essential requirement is for the currency containers to be completely sealed and inaccessible as long as they are outside the receptacle module or a loading table located in a treasury room. Furthermore, for technical reasons as well as safety reasons, another requirement is that a given currency container can be inserted into only a certain receptacle module.

European Patent No. 0,004,436 describes a dispensing unit of the type defined above, whereby the currency container is inserted into the receptacle module in the first insertion direction up to a stop. In the end position thus reached, the contact arrangement of the currency container and the mating contact arrangement of the receptacle module are in contact so the identification code of the currency container and possible other data can be analyzed by the polling and control circuit. If this check reveals that the proper currency container is in the proper receptacle module, then the control circuit controls the locking mechanism by way of an electromagnet in such a way that the locking cover can be unlocked. This locking cover is designed as a slide cover that can be removed from the receptacle module after unlocking, thus releasing a container orifice into which the draw-off rollers of the draw-off mechanism can reach. Then the currency container must be adjusted in the direction of the draw-off and single feed device of the receptacle module across its first direction of insertion and locked in the corresponding position. Starting operation of the dispensing unit thus requires several steps and is relatively tedious.

SUMMARY OF THE INVENTION

This invention is based on the problem of developing a dispensing unit of the type described initially in which operation of the dispensing unit can be initiated in a single operation while retaining all safety requirements.

This problem is solved according to this invention by the fact that the mating contact arrangement is designed in such a way that it can be adjusted in the direction of insertion of the currency container between a starting position near the insertion orifice of the receptacle module and an end position that corresponds to complete insertion of the currency container and on the receptacle module or on the currency container there is an adjustable locking element that can be controlled by the control system and is intended to engage a locking element on the other part (currency container or receptacle module) in such a way that the currency container is a distance away from the draw-off and single-feed system that permits opening of the lock in the engaged position of the locking bar element and the catch element.

The movable mating contact arrangement permits contact to be made between the contacts on the currency container and the mating contacts on the receptacle module at the very beginning of the insertion movement of the currency container. Due to this fact, it is possible to perform the polling of the data necessary for identification of the currency container during the insertion movement. If it is found during the polling that the currency container does not belong in the respective receptacle module, then further insertion of the currency container can be prevented before it has reached its end position in the receptacle module. Conversely, the lock can already be unlocked even before the currency container has reached its end position in the receptacle module. This makes it possible to mechanically open the lock on the last part of the insertion path after unlocking it so the currency container reaches its end position in the receptacle module with the lock opened and thus the draw-off rollers can enter the opening in the currency container. Assuming that the proper currency container has been inserted into the respective receptacle module, then insertion of the currency container can take place in a single continuous movement whereupon the currency container has reached its operating position in the receptacle module at the end of this movement and the dispensing unit is ready for operation.

Preferably, the mating contact arrangement is under pretension in its starting position so it returns automatically to its starting position when the currency container is removed from the receptacle module. At the same time, the contact made between the two contact arrangements can be improved due to this restoring force as long as the respective contact elements are in contact. However, if the contact arrangement and the mating contact arrangement are designed in the form of plug parts whereby the respective contact elements are inserted one into the other, then the corresponding plug forces are necessary to assure a reliable contact is made. In this case it is advantageous for the mating contact arrangement to be held in its starting position by a holding device with a nonpositive friction connection. It is sufficient to adjust the holding force in such a way that it makes it possible to plug the two contact arrangements together but which can be overcome by a slight insertion force. Such holding forces can be produced by snap mechanism. According to a preferred version, however, the holding device includes at least one magnet mounted on the mating contact arrangement or the receptacle module and working together with a magnetizable counterpart on the other respective part (receptacle module, mating contact arrangement). The breakaway force of the magnet must be selected so it is at least slightly greater than the plug force needed to plug the mating contact arrangement and the contact arrangement together.

Preferably, the mating contact arrangement is mounted on a carriage that can slide parallel to the insertion direction along one wall of the receptacle module and in comparison with pure slide guides, it is more advantageous to guide the carriage with rollers on edges of a recess running parallel to the direction of insertion in the wall of the receptacle module. Thus, the contact arrangement can be moved especially easily and also returns automatically to its starting position under only slight restoring forces.

It is expedient for the locking bar element to be under pretension in its locked position and to be adjustable into its release position by an actuating element so it is always in its locked position when it is not receiving an active signal for release of the insertion path. In order to avoid hard impact of the currency container against the locking bar element in its locked position on insertion of the currency container, it is expedient for the locking bar element to be spring mounted in the direction of insertion. This makes it possible to avoid damage to the locking bar element that works together with it.

According to a preferred version of this invention, a second catch element is located some distance opposite the direction of insertion on the part of the dispensing unit that carries the first catch element in such a way that the currency container can be locked in its operating position by engagement of the locking bar element with the second catch element. This eliminates the need for an additional locking bar element in order to lock the currency container in its operating position inside the receptacle module. Preferably, the receptacle module has an end stop for the currency container that can be pushed against a spring force in the direction of insertion. This end stop presses the second locking element into the operating position of the currency container inside the receptacle module in engagement with the locking bar element so the currency container is held in this position with no play. Furthermore, this stop element assures a short return movement of the currency container against the direction of insertion on removal of the currency container from the receptacle module after unlocking the locking bar element, so the locking bar element can no longer enter into engagement with the second catch element even if it could be moved back into the locked position by spring pretension or a corresponding signal.

In a simple, sturdy and expedient design, the locking bar element is formed by a latch mounted on an axle parallel to the bottom of the receptacle module so it can pivot about this axle, in which case the catch elements are formed by pins mounted on the bottom of the currency container. In order for the pins not to interfere with setting the currency container on a flat substrate, it is expedient for each of the pins to be arranged in a recess in the bottom of the currency container. In this case, the latch must be able to engage these recesses in the bottom of the container. In order to avoid the latch which is under pretension in its engaged position or locking position from catching on the lower front edge of the currency container on insertion of the currency container into the receptacle module, the latch is connected to a feeler roller intended for rolling on the bottom of the currency container, so recesses for the catch elements are provided in the bottom of the currency container and the feeler roller falls into these recesses in the locked positions of the catch.

The closure of the currency container can be designed and operated in various ways as long as it is assured that opening of the closing mechanism is possible during the insertion movement of the currency container after the locking mechanism is unlocked and before the currency container has reached its end position in the receptacle module. In order to assure this, it is expedient for an actuating device for the closure to be provided in the currency container so it can be controlled independently of the insertion movement of the currency container in the receptacle module. Thus, regardless of the rate at which the currency container is inserted into the receptacle module, it is always assured that the closure is opened when the currency container reaches its end position in the receptacle module. Preferably the actuating device has an actuating element that is adjustable by means of a control cam in the receptacle module for adjusting the closure. Then, at least that part of the control cam that controls the opening movement of the locking mechanism is arranged in such a way that the actuating element or a cam follower connected to it passes through it on part of the insertion path of the currency container between the engagement position of the locking bar element with the first catch element and the operating position of the currency container in the receptacle module.

Additional features and advantages of this invention will become apparent from the following description which explains this invention further on the basis of a practical example with reference to the accompanying figures.

DESCRIPTION OF THE PREFERRED EMBODIMENT

Figure 1:
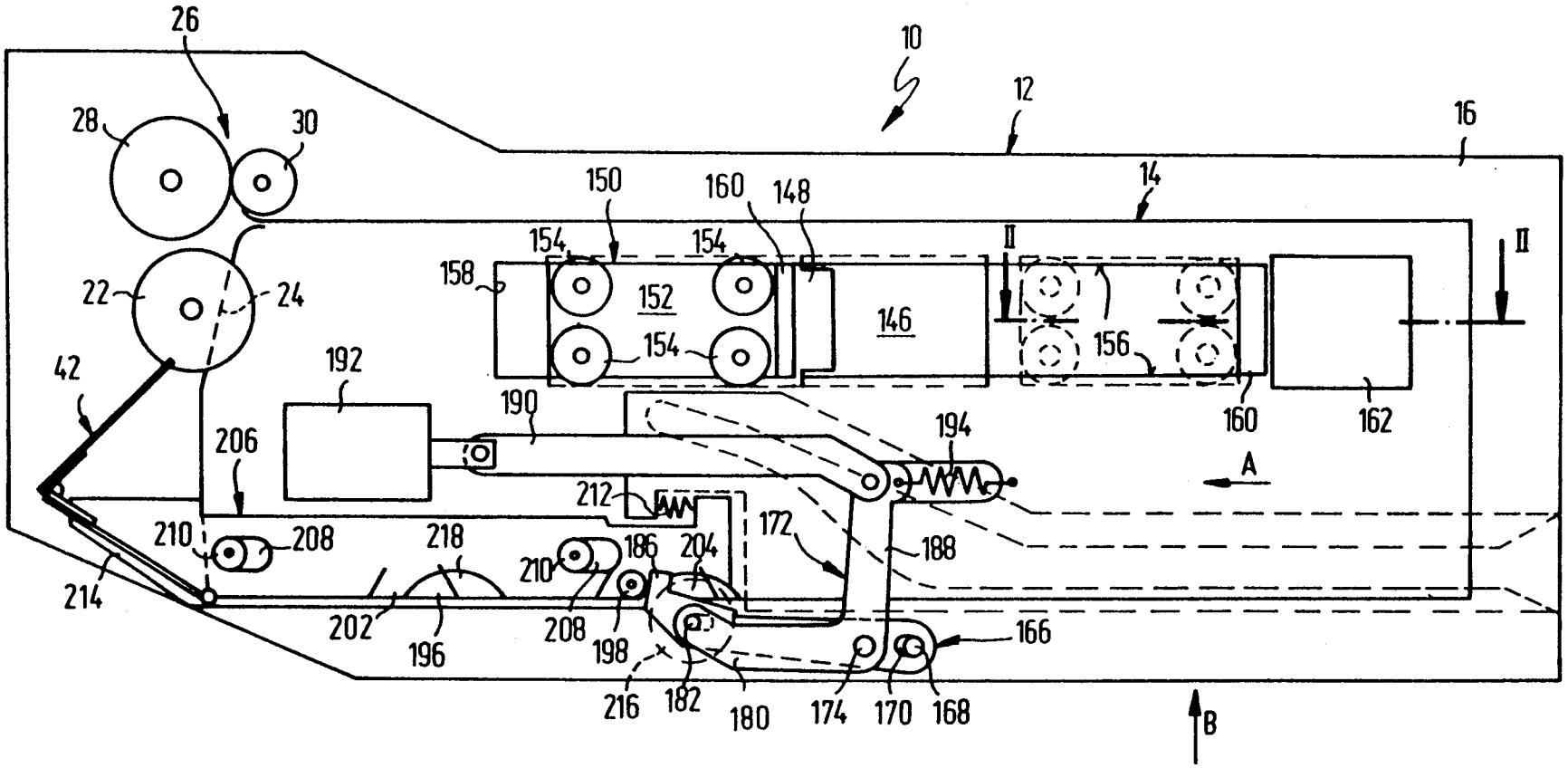
FIG. 1 is a schematic side view of the essential elements of a receptacle module with the contour lines of a currency container inserted into the module.
Figure 7:
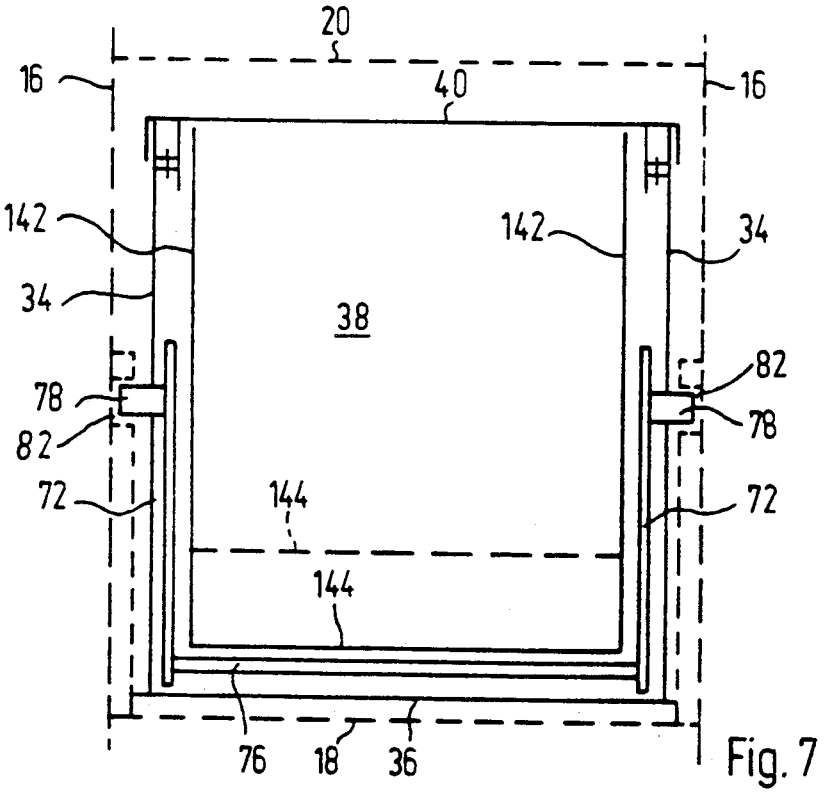
FIG. 7 is a schematic partial sectional view through a currency container according to this invention along VII—VII in FIG. 5, but only part of the lever mounted on the side walls of the currency container is shown.

The dispensing unit labeled as 10 in general in FIG. 1 is used in the construction of automatic money dispensing machines, in which case several such dispensing units are arranged one above the other in order to be able to dispense various types of currency bills. The dispensing unit includes a receptacle module diagrammed only schematically and labeled in general as 12 for a currency container designated in general as 14. The receptacle module 12 is in the form of a cube-shaped channel with side walls 16, a bottom part 18 and a cover part 20 (FIG. 7). Instead of a continuous bottom part 18 or a continuous cover part 20, connecting rods, etc., may also be provided in order to join the two side walls 16 to each other. In the front area of the receptacle module 12, draw-off rollers 22 are mounted between side walls 16 so they can rotate about an axis that is normal to side walls 16, so that in the position of the currency container 14 shown in FIG. 1, these draw-off rollers can pass through a front orifice 24 therein and enter currency container 14 in order to feed individual currency bills from the stack of bills in container 14 upward in the direction of a single feed device 26 which consists conventionally of conveyor rolls 28 and mating rolls 30 that work together with the former and are driven in the same direction of rotation as conveyor rolls 28. In the case where the draw-off rollers 22 feed several currency bills in the direction of the single feed mechanism 26, only the bill directly in contact with conveyor rolls 28 is conveyed further by them whereas the other bills are retained by mating rolls 30.

Plug-in module 12 is open on the end opposite the draw-off rollers 22 so the currency container 14 can be inserted through this opening in the direction of arrow A on slide rails 32 provided on side walls 16 of the plug-in module.

Before detailing the method of making contact between container 14 on insertion into module 12 and the locking mechanism of container 14 in the receptacle module, first the container and the control of the closure on the container will be explained in greater detail.

Figure 5:
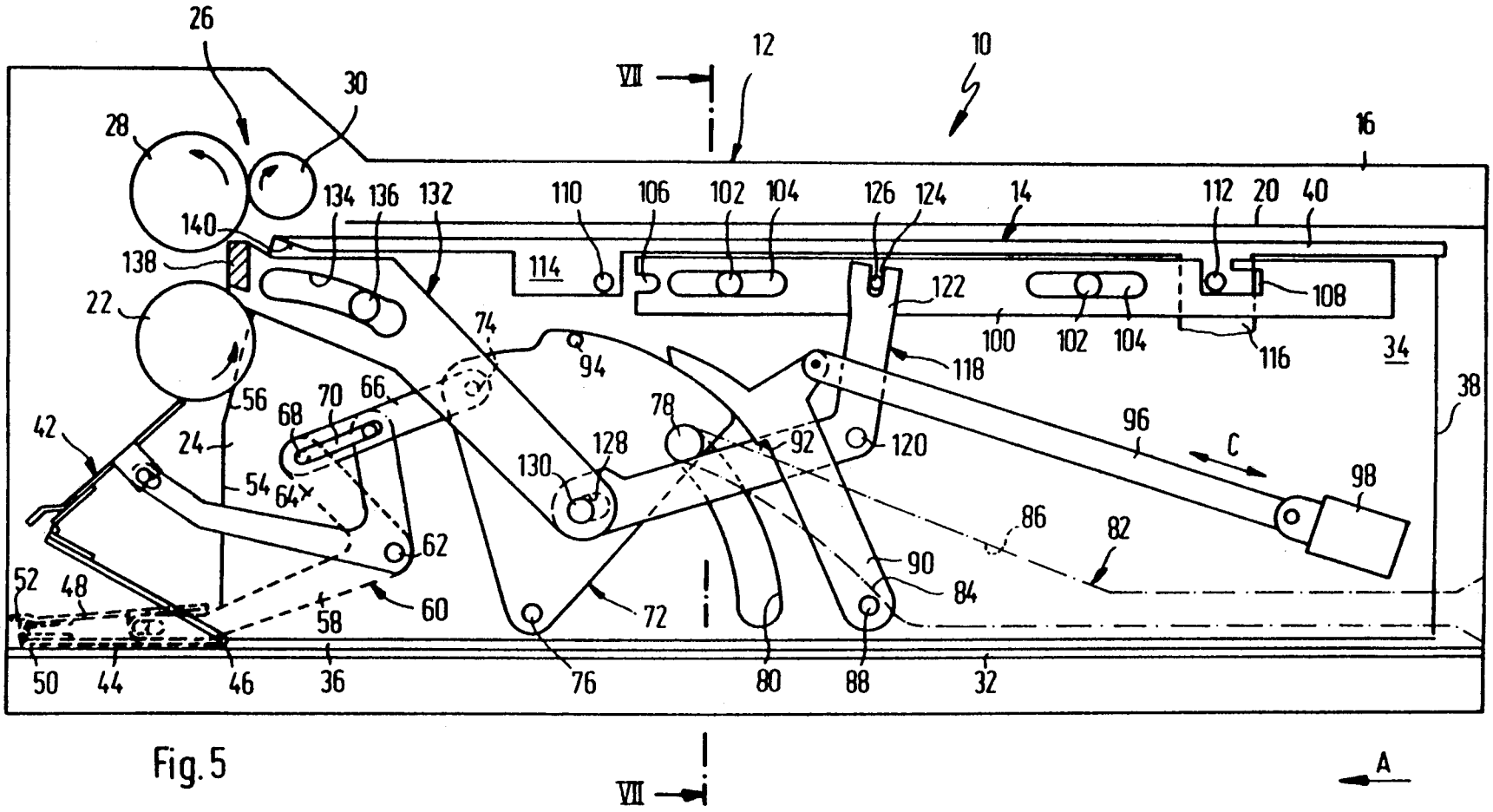
FIG. 5 is a schematic diagram of the dispensing unit with a view of the actuating device for the container closure located on the inside of a side wall of the currency container, where the currency container is in the receptacle module and the lock is opened.
Figure 6:
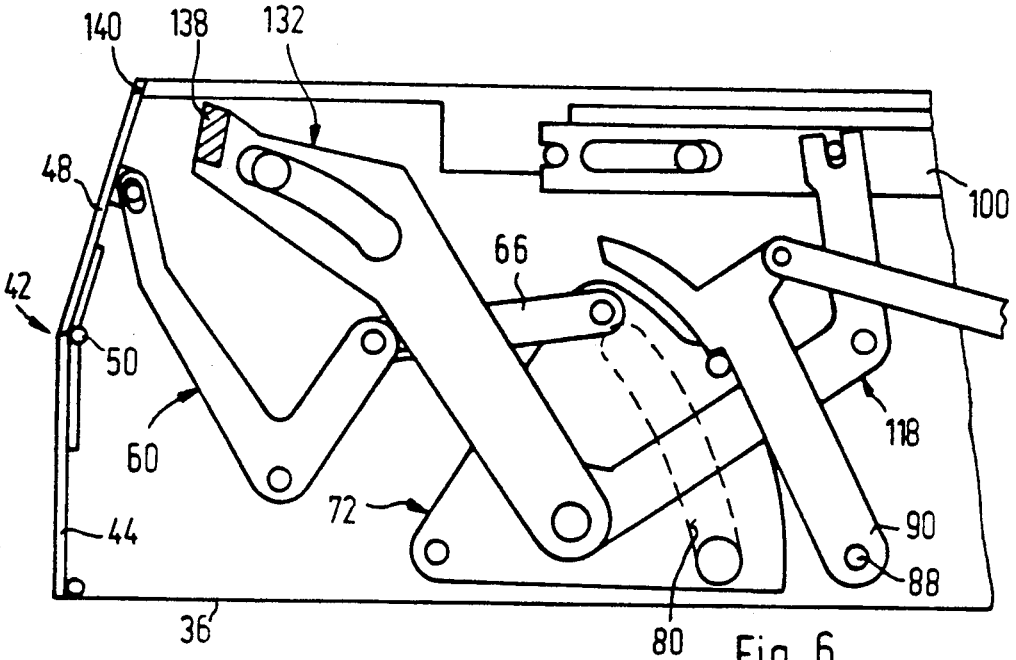
FIG. 6 is a diagram of the currency container alone in a view corresponding to that in FIG. 5 with the closure in closed position.

The container has a cubic shape and includes two side walls 34, a bottom 36 and a rear wall 38, all of which are rigidly joined together. The top side of container 14 can be closed by a cover 40 that is hinged to one of side walls 34 or rear wall 38 so it can be pivoted or it may also be designed to be completely removable. The front side of container 14 opposite rear wall 38 can be closed by a folding flap labeled in general as 42 (FIG. 6). Folding flap 42 includes a first flap part 44 that is hinged to bottom 36 of container 14 so it can pivot about an axle 46 that is parallel to the bottom. A second flap part 48 is hinged to the first flap part 44 on the edge opposite axle 46 so it can pivot about axle 50. The two flap parts 44 and 48 may be formed of solid plates hinged together by a hinge mounted on the inside of each. In this case, the second flap part 58 has an angled section 52 on the edge next to the first flap part 44 to cover the hinge joint between the two flap parts 44 and 48 when the folding flap 42 is closed (FIG. 5).

The front edges of side walls 34 of container 14 have a first vertical section 54 and a second upper section 56 inclined outward the rear wall 38. Accordingly, flap parts 44 and 48 of folding flap 42 assume a position in which they form an angle of less than 180 degrees to each other on the side facing the inside of the container when the folding flap is closed (FIG. 6). Folding flap 42 is adjustable between its open position and its closed position by means of an actuating device located in side container 14 which will not be explained in greater detail. The actuating device includes lever mechanisms mounted on both sides of container 14 and designed to be mirror images of each other, so only one of the lever mechanisms will be described here.

Upper flap part 48 is hinge connected on each side to a lever arm 58 of a V-shaped two-armed guide lever 60 that is mounted in the rear of its V crown point about an axle 62 that is mounted on side wall 34 and is normal to it. The other lever arm 64 is hinge connected to one end of a double guide arm 66 and a pin 68 mounted on lever arm 64 fits into a slit-shaped elongated hole 70 in the double guide arm 66. In this way, folding flap 42 can assume the two positions indicated by solid lines and dash-dot lines in FIG. 1 while the other levers are otherwise in the same position. The half-opened position indicated by solid lines is assumed by folding flap 42 in receptacle module 12, because the space beneath it is already needed for the draw-off and conveyance mechanism of the module 12 beneath it. Its completely opened position which is indicated by dotted lines in the figure is assumed by folding flap 42 on the loading table, the front opening 24 is completely opened for input of currency bills or for maintenance measures (FIG. 5).

The double guide arm 66 is hinge connected at the end opposite the guide lever 60 to a triangular rocker 72 so it can pivot about axle 74. Rocker 72 is mounted close to one corner of the triangle so it can pivot about a shaft 76 near the bottom in side walls 34. The shaft 76 here extends over the entire width of container 14 so the two rockers 72 are mounted on the same shaft 76. On the side facing side wall 34, rocker 72 has a pin 78 that projects out of container 14 through a curved slit 80 around shaft 76 in side wall 34. On insertion of container 14, this pin 78 engages a crank 82 which is mounted on the inside of the corresponding side wall 16 of receptacle module 12 and is also mounted on a suitable guide on a loading table. Crank 82 includes a control cam 84 that controls the opening movement of folding flap 42 and it also includes a control cam 86 that controls the closing movement of folding flap 42. As FIG. 5 shows, the paths described by these two control cams are not parallel. When container 14 is plugged into receptacle module 12, the pivoting movement of rocker 72 begins and thus the opening movement of folding flap 42 starts with the beginning of the rising slope of control cam 84 which then rises steeply from this starting point so the opening movement of folding flap 42 is completed in a relatively short segment of the insertion path. As explained later in greater detail, the delayed beginning of the opening movement has the purpose of gaining enough time to be able to poll the data necessary for identification of container 14 during insertion of container 14 into receptacle module 12 and if necessary, prevent container 14 from further insertion by means of a blocking device if the results of the inquiry reveal that container 14 does not fit into the respective receptacle module 12. The steep slope of control cam 84 is irrelevant in the opening movement of folding flap 42, because the actuating device for opening folding flap 42 need apply practically no force. Folding flap 42 drops into its opened position due to the force of gravity as permitted by the levers connected to it.

In the closing movement, however, closing forces must be applied against the force of gravity. For this reason, the control cam 86 that controls the closing movement is much shallower so it also extends up to a point closer to the insertion end of module 12.

As these figures also show, the guide lever 60 with its first lever arm 58 and flap parts 44 and 48 forms a first four-bar linkage and with its second lever arm 64, the double guide arm 66 and rocker 72 forms a second four-bar linkage. This second four-bar linkage makes it possible to reduce the relatively large pivot angle of guide lever 60 between its two end positions to a smaller pivot angle of rocker 72 so the control path for pin 78 can also be shortened. This makes it possible to guide pin 78 first in a straight line before an opening movement of folding flap 42 is initiated.

In order to prevent manual operation of folding flap 42 by shifting of pin 78 that projects out of the side walls 34 of the container, rocker 72 can be locked in the closed position of folding flap 42 (FIG. 6). To do so, a locking lever 90 is mounted on side walls 34 so it can pivot about an axle 88 that is close to the bottom and in the locked position it reaches with a projection 92 behind a pin 94 mounted on rocker 72. In order to release rocker 72 and thus permit an opening movement of folding flap 42, locking lever 90 can be pivoted over a tension rod 96 that is hinge connected to it and is adjustable by an electromagnet 98 in the direction of double arrow C. Electromagnet 98 is mounted in a rear section of container 14 where it does not have a negative effect on the use of the interior of the container. Rocker 72 is slightly overdriven in the closing direction by the guidance of pin 78 on control cam 86, so locking projection 92 can drop behind locking pin 94 without hindrance so that electromagnet need only cause a pushing movement of rod 96 but need not apply a closing force in locking the mechanism.

With the opening and closing of folding flap 42, cover 40 may also be unlocked or locked at the same time. This is accomplished by a locking rail 100 that is mounted so it can move along the side wall and parallel to cover 40 by means of elongated hole pin guides 102, 104 and it has two recesses 106 and 108 that are engaged by pins 110 and 112 that are mounted on straps 114 and 116 that are connected to the cover and enter container 14 when cover 40 is closed. The movement of the locking rail 100 takes place by means of a two-arm angle lever 118 that is mounted so it can pivot about an axle 120 on side wall 34 and has a fork opening 124 on one lever arm 122 which is engaged by a pin 126 connected to the locking rail 100. The other lever arm of the angle lever 118 has an elongated hole 128 which is engaged by a pin 130 mounted on rocker 72.

The same pin 130 connects each rocker 72 to a crank lever 132 that is pointed toward opening 24 of container 14 and has a slit-shaped crank 134 which is engaged by a pin 136 mounted on side wall 34. The two crank levers 132 hold a trapezoidal rigid rod 138 that is aligned parallel with the axle of draw-off roller 22 and is pushed out of container 14 when the latter is opened so it engages the gap between draw-off rollers 22 and conveyor rolls 28. The position of rod 138 here is such that the currency bills fed by draw-off rollers 22 are guided between rod 138 and top edge 140 of opening 24 through to the single feed device 26.

If container 14 is to be removed from the receptacle module 12, any currency bills at the roll gap of the single feed device 26 and thus projecting out of container 14 must be retracted back into the container. This is accomplished by rod 138 which is guided in a closing movement of rocker 72 due to the shape of crank 134 in such a way that it is retracted into container 14 past the upper edge 140 of opening 24 in which case it also entrains any currency bills still projecting out of the container 14 back into the container. Thus, folding flap 42 can be closed without leaving any currency bills sticking out of the flap.

FIG. 7 shows that container 14 has an outside part consisting of the two walls 34, the bottom 36, the rear wall 38, the cover 40 and the folding flap 42 and it has an inside part that includes side walls 142 parallel to side walls 34 and a bottom part 144 that can be adjusted in height, and side walls 34 of the outside part and side walls 142 of the inside part enclose the lever mechanism for actuation of folding flap 42 between them. The inside part is for holding a stack of paper currency.

Figure 2:
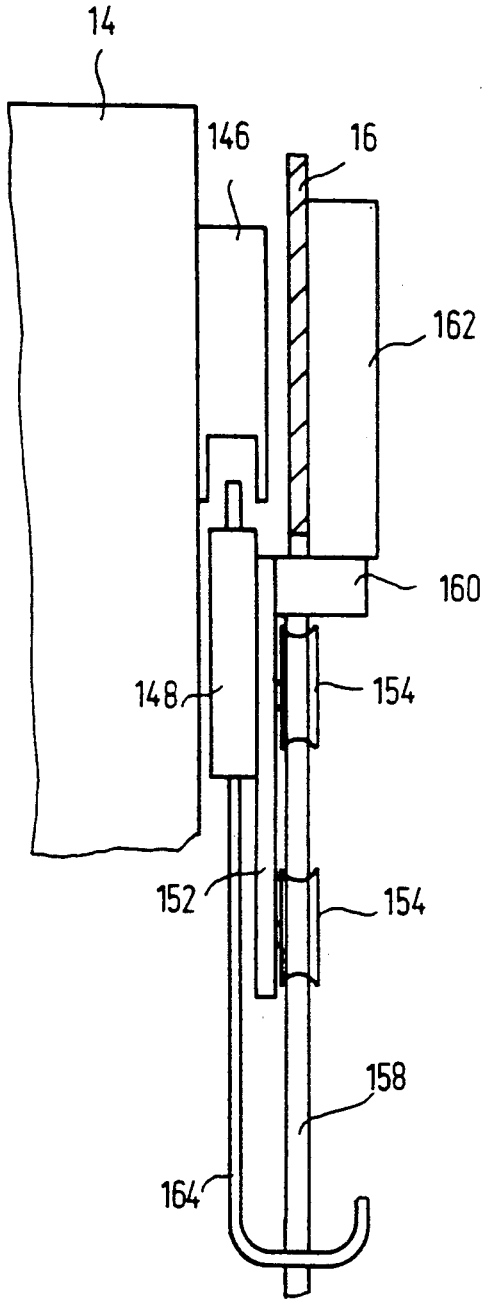
FIG. 2 is a schematic partial sectional view along line II—II in FIG. 1.

As already explained above, the opening of folding flap 42 should take place only when it has been ascertained that the proper cassette 14 is being inserted into the respective receptacle module 12. Therefore, a plug 146 is mounted on the outside of a side wall 34 of container 14 and is connected to a circuit inside container 14. This circuit includes a memory for storing the data that permits identification of the currency container. Furthermore, plug 146 also provides the connection to electromagnet 98. Plug 146 has a counterplug 148 that is guided by means of a carriage 150 on a side wall 16 of receptacle module 12 parallel to the direction of insertion, denoted by the letter A. Plug carriage 150 includes a plate 152 on which four rollers 154 are mounted so they can rotate and roll on the edges 156 that run parallel to the direction of insertion in an elongated rectangular recess 158 provided in side wall 16 of receptacle module 12. These edges 156 fit into a peripheral groove on rollers 154 so the carriage cannot fall out of recess 158 (see FIG. 2). The counterplug 148 is mounted on the inside of plate 152. On the side facing outward, plate 152 has an iron part 160 (FIG. 2) which is provided for a holding magnet 162 which is mounted on the end of recess 158 that is near the plug in the opening of receptacle module 12 (mounted on the outside of side wall 16). Holding magnet 162 holds the plug carriage 150 in its position near the plug in the opening by means of iron part 160 with a force that is greater than the plugging force required to plug the two plug parts 146 and 148 together. Thus on insertion of currency container 14 into receptacle module 12, plug carriage 150 is not moved in the direction of insertion until the two plug parts 146 and 148 have been pushed together completely and thus a secure contact of the contact elements provided in them is assured and the holding force of holding magnet 162 is overcome. Plug part 148 on plug carriage 150 is connected by a flexible flat band cable 164 to a polling and control unit (not shown) of the automatic money dispensing machine, so with further insertion of the currency container 14 into receptacle module 12, the memory in the currency container 14 can be polled. Plug carriage 150 is under pretension by a spring (not shown) in its starting position close to the plug-in opening so it returns to its starting position in any case after container 14 has been pulled out of the receptacle module.

Figure 4:
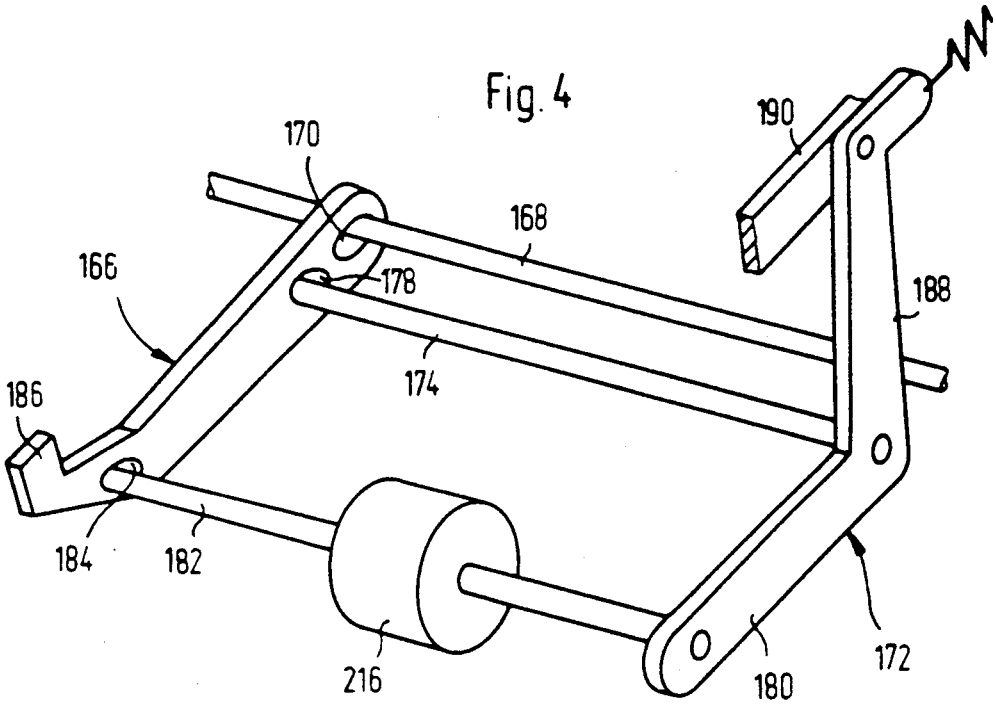
FIG. 4 is a schematic perspective view of the locking mechanism for the currency container in the receptacle module alone.
Figure 3:
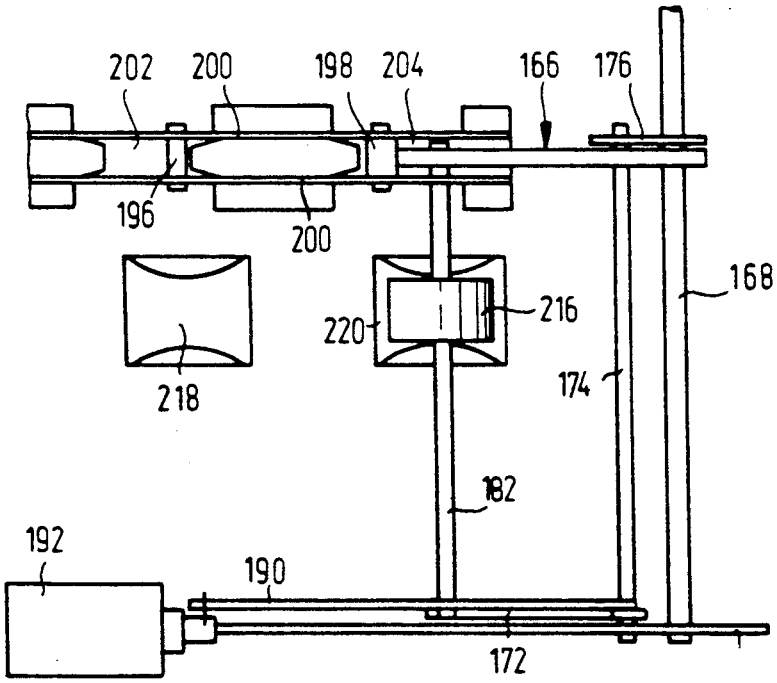
FIG. 3 is a view of the locking mechanism for locking the currency container in the receptacle module as seen in the direction of arrow B in FIG. 1.

A locking mechanism is provided on receptacle module 12 and is intended to prevent the insertion of an incorrect currency container 14 into receptacle module 12 while on the other hand, once a currency container 14 has been completely inserted into receptacle module it locks it in receptacle module 12. To explain the design and functioning of the locking mechanism, reference is made below to FIGS. 1, 3 and 4.

The locking mechanism includes a safety catch 166 that is mounted so it can pivot on a shaft 168 that runs across the entire width of receptacle module 12 beneath the bottom 36 of container 14. Shaft 168 is mounted in the side walls 16 of receptacle module 12 and is designed as a spring rod so safety catch 166 can be deflected slightly with a spring action parallel to the direction of insertion A. Shaft 168 passes through safety catch 166 in an elongated hole 170.

Since safety catch 166 is located in a middle area between side walls 16 of receptacle module 12 beneath the bottom of container 14, it is difficult for reasons of space to actuate the safety catch directly. Therefore, an angle lever 172 mounted so it can pivot about a shaft 174 near one side wall 16 of the receptacle module serves to actuate the safety catch. Shaft 174 is in turn mounted with one end in a side wall 16 of receptacle module 12 and with the other end in a flange 176 that projects downward from bottom part 18 of receptacle module 12. Shaft 174 passes through catch 166 in an elongated hole 178 that is larger than the diameter of shaft 174 so the safety catch 166 can execute a pivoting movement about shaft 168 despite the stationary shaft 174.

Lever arm 180 of angle lever 172 that runs approximately parallel to safety catch 166 forms the bearing for another shaft 182 on its front end where shaft 182 extends parallel to shafts 174 and 168 and with its other end is mounted in an elongated hole 184 in safety catch 166 near its catch projection 186.

The essentially vertical lever arm 188 of angle lever 172 is hingedly connected to a tension rod 190 that is adjustable essentially in parallel to the direction of insertion A by means of an electromagnet 192. Electromagnet 192 is located in a recess in side wall 16 of receptacle module 12 (see FIGS. 1 and 3). Furthermore, a tension spring 194 acts on the free end of lever arm 188 and is suspended at its other end on side wall 16 and applies pretension to angle lever 172 in a clockwise direction (as seen in FIG. 1). It can be seen that this likewise causes safety catch 166 to be put under pretension into its locked position in a clockwise direction.

Safety catch 166 cooperates with two locking pins 196 and 198 which are held inside currency container 14 close to bottom 26 between two connecting pieces 200 that are secured to the bottom inside of container 14. In the area of locking pins 196 and 198, bottom 36 has apertures 202 and 204 which engage safety catch 166 with its locking projection 186 and with which locking pins 196 and 198 can be engaged.

It can now be seen from the diagram in FIG. 1, that upon insertion of container 14 into receptacle module 12, first locking pin 196 is stopped at locking projection 186 of safety catch 166 when the latter assumes its locked position as shown in FIG. 1. In this position, pin 78 on rocker 72 of container 14 that is guided in control crank 82 is at the beginning of control cam 84 so the opening of folding flap 42 has not yet begun. However, if a check of the data in container 14 reveals that it can be inserted further into receptacle module 12 then first electromagnet 98 is actuated and thus rocker 72 is unlocked. Furthermore, electromagnet 192 is actuated and then pulls on tension rod 190 and pivots angle lever 172 in a counterclockwise direction as seen in FIG. 1. Thus safety catch 166 is also pivoted in counterclockwise direction so container 14 can be inserted completely into receptacle module 12. After magnet 192 has been deactivated safety catch 166 with its locking projection 186 automatically drops into opening 204 in the bottom 36 of container 14, falling behind locking pin 198, under the action of spring 194, so that container 14 is now secured against removal from receptacle module 12. Container 14 cannot be removed again until safety catch 166 is pivoted counterclockwise by actuation of electromagnet 192 thus releasing locking pin 198. At this instant, container 14 experiences a short return thrust in the removal direction, preventing safety catch 166 from falling back into its locked position behind locking pin 198 if electromagnet 192 is excited only briefly. The return thrust takes place under the influence of a spring mounted stop rail 206 that is mounted so it can move parallel to the direction of insertion by means of elongated hole pin guides 208, 210 on one side wall 16 of receptacle module 12 and the stop rail is under pretension in the removal direction by means of a compression spring 212 in which case the compression spring 212 rests on a stop permanently attached to the side wall of receptacle module 12. Stop rail 206 has an initial incline 214 on its front end, holding folding flap 42 in a half-opened position and at the same time serving as a stop face for container 14.

To prevent container 14 from being caught with its lower front edge (in the area of shaft 46) on locking projection 186 of safety catch 166 on insertion, a feeler roller 216 made of foam is mounted on shaft 182 so it can rotate, and it rolls on bottom 36 of container 14 when the container is inserted and thus pivots the safety catch counterclockwise against the action of spring 194 and moves the front edge of container 14. However, in order for safety catch 166 with its locking projection 186 to be able to engage locking pins 196, 198, two recesses 218 and 220 are provided in the bottom 36 of container 14 for locking pins 196 and 198 in the path of feeler roller 216 so the roller enters these recesses when safety catch 166 is to be engaged with locking pins 196 and 198.

We claim:

1. A dispensing unit for paper currency, comprising:

a receptacle module with a first contact, said first contact being connected to a polling circuit that stores a desired predetermined code;

a box-shaped currency container that stores currency and which can be inserted into said receptacle module in an insertion direction from an insertion position on said receptacle module, said currency container having an orifice, a second contact, and a second circuit for storing a predetermined identification code, said second contact being connected to said second circuit;

said receptacle module having means to remove currency from said currency container through said orifice;

said first contact being mounted so that it can be moved between a starting position on the receptacle module near the insertion position where said currency container will be inserted and an end position that corresponds to complete insertion of said currency container; and an adjustable locking bar mounted on said receptacle module, said second contact being received by said first contact in order to communicate information between said polling circuit and said second circuit in order to determine whether said currency container is appropriate for insertion within said receptacle module and wherein blocking means are associated with said adjustable locking bar to block complete insertion of said currency container into said mounting receptacle, said blocking means deactivatable to a release position to allow complete insertion of said currency container if said identification code corresponds to said desired predetermined code for said module.

2. A dispensing unit according to claim 1, including means to bias said first contact towards its starting position.

3. A dispensing unit according to claim 2, wherein said first and second contacts are mating plug parts, and said first contact is biased towards its starting position by a holding device and said bias is overcome when said first and second contacts are mated and the insertion force applied to said currency container is transmitted to said first contact.

4. A dispensing unit according to claim 3, wherein said holding device includes at least one magnet that is fixed to one of said first contact or said receptacle module and which interacts with a magnetizable counterpart on the respective other part.

5. A dispensing unit according to claim 1, wherein said first contact is arranged on a carriage that can move along a wall of said receptacle module parallel to the direction of insertion.

6. A dispensing unit according to claim 5, wherein said carriage is guided with rollers on edges of a recess that extends parallel to the direction of insertion in said wall of said receptacle module.

7. A dispensing unit according to claim 1, characterized by the fact that said locking bar is movable between a blocking position and a release position, said blocking means selectively biasing said locking bar into said blocking position.

8. A dispensing unit according to claim 7, characterized by the fact that said locking bar is mounted so it can move parallel to the direction of insertion, and is biased in said direction by a spring.

9. A dispensing unit according to claim 1, wherein said currency container has first and second catch elements spaced on said currency container in the direction of insertions, aid locking bar engaging said first catch element when in its blocking position and engaging said second catch element upon complete insertion of said currency container.

10. A dispensing unit according to claim 9, wherein said locking bar comprises a member mounted so it can pivot about an axle parallel to the bottom of said receptacle module and said catch elements are formed by pins mounted on the bottom of said currency container.

11. A dispensing unit according to claim 10, characterized by the fact that said catch elements each correspond to a recess of the bottom of said currency container, and said locking bar comprises a feeler roller intended for rolling on the bottom of said currency container, said feeler roller dropping into a blocking recess at said blocking position and dropping into an insertion recess upon complete insertion of said currency container.

12. A dispensing unit according to claim 1, wherein said receptacle module has an end stop for said currency container that can be moved against a spring force in the direction of insertion.

13. A dispensing unit according to claim 1, wherein said currency container has a closing element for covering said orifice and an actuating device for said closing element is provided in said currency container that controls said closing element depending on the degree of insertion of said currency container into said receptacle module.

14. A dispensing unit according to claim 13, wherein said actuating device includes an actuating element that is adjustable by a control cam formed on the receptacle module.

15. A dispensing unit according to claim 1, wherein said stored predetermined identity code identifies said currency container as a particular type of currency container and said desired predetermined code identifies desired types of currency containers for said receptacle module.

16. A dispensing unit for paper currency comprising:

a receptacle module with a first contact, said first contact being connected to a polling circuit that stores a desired predetermined code;

a box-shaped currency container that stores currency and which can be inserted into said receptacle module in an insertion direction from an insertion position on said receptacle module, said currency container having an orifice, a second contact, and a second circuit for storing a predetermined identification code, said second contact being connected to said second circuit;

said receptacle module having means to remove currency from said currency container through said orifice;

said first contact being mounted so that it can be moved between a starting position on the receptacle module near the insertion position where said currency container will be inserted and an end position that corresponds to complete insertion of said currency container;

an adjustable locking bar mounted on said receptacle module, said second contact being received by said first contact in order to communicate information between said polling circuit and said second circuit in order to determine whether said currency container is appropriate for insertion within said receptacle module and wherein said adjustable locking bar element normally blocks complete insertion of said currency container and is deactivated into a release position to allow complete insertion of said currency container if said identification code corresponds to said desired predetermined code for said module; and an adjustable closing element movable between positions opening and closing said orifice on said box-shaped currency container and having a locking device for locking said closing element, said closing element comprising a folding flap with a first flap part pivotally mounted about a first flap axis and a second flap part pivotally mounted about a second flap axis, said first and second axes being parallel, said two flap parts being pivoted in opposite directions relative to each other to open and close said orifice, said two flap parts forming an angle of less than 180 degrees to each other in the closed portion measured from the sides of said flaps facing the inside of said currency container.

17. A dispensing unit for paper currency comprising:

a receptacle module;

a box-shaped currency container which can be inserted in a direction of insertion into said receptacle module and which has an orifice;

means on said receptacle module to remove currency from said currency container orifice; and an adjustable closing element movable between positions opening and closing said orifice on said box-shaped currency container and having a locking device for locking said closing element, said closing element comprising a folding flap with a first flap part pivotally mounted about a first flap axis and a second flap part pivotally mounted about a second flap axis, said first and second axes being parallel, said two flap parts being pivoted in opposite directions relative to each other to open and close said orifice, said two flap parts forming an angle of less than 180 degrees to each other in the closed portion measured from the sides of said flaps facing the inside of said currency container.

18. A dispensing unit according to claim 17, characterized by the fact that said folding flap is adjustable by means of two guide levers each having first and second lever arms which are pivotably mounted on the side walls of said currency container, said side walls pointing parallel to the direction of insertion, said first lever arms hinged to said second flap part and said second lever arms hinged to an actuating means, said means being capable of pivoting said guide levers.

19. A dispensing unit according to claim 18, characterized by the fact that said actuating means includes rockers pivotably mounted on the side wall of said currency container, said rockers having a first pin that passes through said currency container wall and is associated with a control cam provided in said receptacle module.

20. A dispensing unit according to claim 19, characterized by the fact that said second lever arms of said guide levers are each connected to their respective rockers by two guide arms.

21. A dispensing unit according to claim 20, characterized by the fact that the connection between said guide levers and said two guide arms includes an elongated hole formed in each of said two guide arms and a second pin on each of said second lever arms of said guide levers where said second pin fits into said elongated hole.

22. A dispensing unit according to claim 21, wherein said actuating means is locked in a position maintaining said folding flap in a closed position by an electromechanical locking mechanism.

23. A dispensing unit according to claim 22, characterized by the fact that said currency container has a cover on its top side that can be locked by a lock device positioned inside said currency container, said lock device connected to one of said rockers by a control lever in such a way that said lock device is adjustable between a release position and a locked position.

24. A dispensing unit according to claim 23, characterized by the fact that cranks intended for controlling each of said rockers are mounted on the side walls of said receptacle module each with a first control cam that controls an opening movement of said rockers and a second control cam that controls a closing movement of said rockers, a path described by said first control cam being shorter and steeper than a path described by said second control cam.

25. A dispensing unit according to claim 24, wherein said means to remove currency comprise draw-off rollers and conveyor rollers, and there is a rod that extends over the width of said orifice of said currency container, parallel to the bottom thereof, and said rod is movable between an extended position in which it is outside said currency container and is in a gap between said draw-off rollers and said conveyor rollers, and a retracted position in which it is inside said currency container.

26. A dispensing unit according to claim 25, wherein said rod is mounted at its longitudinal ends on crank levers that are guided so they can move along the walls of said currency container by means of an elongated hole pin guide and at the ends remote from the rod, they are hinge connected to said respective rocker so they can pivot.

* * * * *